United States Patent [19]

Baumert

[11] 4,359,211

[45] Nov. 16, 1982

[54] METHOD OF AND APPARATUS FOR MEASURING LEVEL AND CHARACTERISTICS OF A SLAG LAYER OVERLYING A METALLURGICAL METAL

[75] Inventor: Jean Baumert, Esch/Alzette, Luxembourg

[73] Assignee: Arbed S.A., Luxembourg

[21] Appl. No.: 169,481

[22] Filed: Jul. 15, 1980

[30] Foreign Application Priority Data

Jul. 16, 1979 [LU] Luxembourg ..... 81512

[51] Int. Cl.³ ..... G01F 23/18; C21B 7/24

[52] U.S. Cl. ..... 266/99; 73/302; 266/94

[58] Field of Search ..... 73/299, 302; 266/94, 266/81

[56] References Cited

U.S. PATENT DOCUMENTS

| | | | |
|---|---|---|---|
| 3,200,971 | 8/1965 | Trethewey | 73/302 X |
| 3,476,538 | 11/1969 | Trethewey | 73/302 X |
| 3,590,843 | 7/1971 | Meyer | 73/299 X |
| 3,780,581 | 12/1973 | Acre et al. | 73/302 |
| 3,850,416 | 11/1974 | Jackson | 266/99 X |
| 4,102,190 | 7/1978 | Fradeneck et al. | 73/302 |
| 4,114,675 | 9/1978 | Bührer | 164/457 |
| 4,252,173 | 2/1981 | Charbonnier | 164/457 |
| 4,288,062 | 9/1981 | Gupta et al. | 266/81 X |

FOREIGN PATENT DOCUMENTS

| | | | |
|---|---|---|---|
| 2354003 | 6/1974 | Fed. Rep. of Germany | 73/302 |
| 1363687 | 4/1964 | France | 266/94 |
| 1481242 | 5/1967 | France | 266/94 |
| 1540757 | 8/1968 | France | 266/81 |
| 2250985 | 11/1973 | France | 73/302 |
| 2010497 | 5/1979 | France | 266/94 |

*Primary Examiner*—Daniel M. Yasich
*Attorney, Agent, or Firm*—Karl F. Ross

[57] ABSTRACT

A method of and an apparatus for determining the level of slag above a metallurgical melt, especially a steel melt, and for determining a physical characteristic or property of the slag, such as its viscosity or consistency, utilizes a plurality of nozzles opening into the bath-containing vessel at different levels above the melt and supplied with inert gas. The difference in hydrostatic pressures at the nozzles can be ascertained by measurement of the pressures upstream thereof and the measured values are converted into indications of slag level and consistency.

11 Claims, 2 Drawing Figures

METHOD OF AND APPARATUS FOR MEASURING LEVEL AND CHARACTERISTICS OF A SLAG LAYER OVERLYING A METALLURGICAL METAL

FIELD OF THE INVENTION

My present invention relates to a method of and an apparatus for determining the location or thickness, especially the level, of a slag layer overlying a metallurgical melt, such as a steel-refining melt in a converter, and for determining a physical property of the slag such as the slag viscosity or consistency.

BACKGROUND OF THE INVENTION

Ascertainment of the level of the slag layer on a metallurgical melt is vital for many purposes, especially in the refining of steel where the slag overlies a bath of molten steel or iron in a converter or like vessel. This knowledge is essential for monitoring the progress of the refining operation and from a safety viewpoint to prevent overflow of the slag from the converter.

Various systems have been provided heretofore for measuring slag levels or the like, including the systems described in my U.S. Pat. Nos. 4,098,128 and 4,175,612. In addition, the assignee of the instant application has also developed a system for measuring the level of slag which permits a concurrent determination of the consistency thereof, thereby providing significant information, e.g. for the refining of phosphorus melts and where frothy slags are deemed to be desirable.

This system, described in Luxembourg Pat. No. 71,261, comprises a thermostatically temperature-controlled acoustic conduit which is disposed above the converter and which captures the noise emitted or generated by the lance which blows the melt with oxygen.

After filtering foreign frequencies from the electrical signals resulting from the noise detection, one can obtain a signal which, with appropriate interpretation, can represent the noise absorbed by the slag and hence the degree of the frothy character thereof as well as the position of the slag layer in the converter.

However, this system cannot be used with more elaborate refining processes as are described in an application for patent in Luxembourg No. 81,207 filed Apr. 30, 1979. As pointed out in this document, in addition to blowing of oxygen onto the surface of the melt, splashing is generated by the introduction of a mixing gas at the bottom of the vessel or crucible. This results in a slag of a nonfrothy consistency which is highly advantageous with respect to the post combustion of carbon monoxide above the bath. The disappearance of a frothy slag, however, eliminates the possibility of obtaining effective level and consistency measurements using the previously mentioned techniques.

The more dense slag resulting from bottom blowing of the melt with inert gas and the bubbling or splashing of and through the melt, requires another approach than noise absorption or like acoustic techniques for ascertaining the physical parameter or level of the melt.

OBJECTS OF THE INVENTION

It is the principal object of my present invention to provide an improved method of measuring or ascertaining the level of a slag layer above a metallurgical melt, and of determining at least one physical parameter of the slag layer, such as its consistency or viscosity, free from the disadvantages of earlier systems as described above.

Another object of the invention is to provide a device, apparatus or system for such measurements which will not be rendered ineffective should the slag be relatively dense.

Yet a further object of this invention is to provide a method of and an apparatus for measuring the level of slag above a steel-refining melt in a converter, crucible or other vessel which does not depend upon noise or sound absorption and hence is not limited in application to frothy slags.

SUMMARY OF THE INVENTION

These objects and others which will become apparent hereinafter are attained, in accordance with the present invention by providing at least two different levels in the wall of the vessel and above the metallurgical melt upon which the slag layer is formed, a plurality of fluid inlets through which an inert gas is blown and which serve as detectors of hydrostatic pressure which are in the form of flow-controlled jets of the inert gas adjusted so that the inlet pressures or upstream pressures of the jets are equal in the absence of the slag layer. The change in back pressure at the jets is measured and this measurement is utilized to reflect hydrostatic conditions within the vessel changing as a function of the level and physical charcteristics of the slag. The measured pressure deviations, from their original values, thus are able to provide an accurate indication of both the slag level and the slag consistency or viscosity.

The jets constituting the hydrostatic pressure sensors are blown with an inert gas, preferably nitrogen, ensuring that the mouths of these jets at the inner face of the refractory lining of the vessel in which the pressure detectors are provided, remain clear even in the event of splashing.

Thus the system of the present invention enables a continuous measurement of the hydrostatic conditions at two or more inert-fluid inlets in the wall of the vessel while ensuring that these inlets will remain clear and unaffected by the rheological and process conditions prevalent therein.

The principle of the process of the invention is in accordance with the relationship that the back pressures in the inlets are proportional to the product of density of the slag and the height thereof above the lower inlets and can be readily understood as follows:

Assume that three pressure inlets (jets) $A_1$, $A_2$ and B are provided in a vertical wall of the crucible, converter or other refining vessel containing a melt of molten metal, especially steel. The two pressure inlets $A_1$ and $A_2$ are provided above the melt at the same level and at a given distance H thereabove; the inlet B opens into the vessel.

The inlet $A_1$ serves as a reference inlet whose function will be described in greater detail below.

The three inlets are supplied with inert gas initially establishing a flow therein and the flow to inlet $A_1$ is adjusted such that a back pressure $PA_1$ is detected upstream of the inlet $A_1$. This is the reference pressure. The flows to the inlets $A_2$ and B, opening freely into the vessel, are adjusted so that the equivalent upstream or back pressures $PA_2$ and PB, respectively, are equal to $PA_1$.

Since all of these pressures are equal, the pressure difference $PA_1$-PB or $PA_2$-PB are each 0.

When the slag level rises to the level of the inlets $A_1$ and $A_2$, the back pressures $PA_1$ and $PA_2$ increase while the pressure PB remains unchanged. As the slag level rises the change in pressure at the inlets $A_1$ and $A_2$, namely $\Delta PA_1$ and $\Delta PA_2$ will equal $\rho h$ where h is the height of the slag level above the level of the inlets $A_1$ and $A_2$ and $\rho$ is the specific gravity or density of the slag. The value of $\rho h$ is thus the hydrostatic "head" of the slag above the level of inlets $A_1$ and $A_2$.

When the slag reaches the level of inlet B, the change in the pressure PB will signal the fact that $\Delta PA_1$ and $\Delta PA_2$ are equal to $\rho H$ and, since H is known, the value of $\rho$, a physical parameter of the slag, can be immediately ascertained from $\rho = \Delta PA_1/H$.

As the level of the slag rises further, the value of $\Delta PA_1$ and increases proportionally the value of $\rho h$ and, $\rho$ being known from the above equation, h can be determined by the relationship $H = \Delta PA_1/\rho$.

Thus the method of the present invention permits calculation both of the level of the slag and the physical characteristics thereof in terms of the specific gravity or density.

It has been found to be advantageous to provide two pressure inlets at the same lower level in the wall of the vessel so that reliable measurements can be assured. Both should, of course, at all times give identical results and when such identical results are obtained with a number of charges, the system can be considered reproducible and one of the lower pressure inlets can be cut off and its pressure detector and valve system disconnected.

The apparatus of the present invention can comprise two nozzle arrangements which are mounted at different levels in the wall of the crucible or converter, each of which can include a rigid pressure-inlet tube disposed in refractory brick or block mounted in the lining of the wall. This rigid tube can be connected by a flexible tube which traverses the shell of the wall and can communicate with the pressure measuring means, i.e. a source of pressure and a manometer or the like.

The shell of the vessel thus need only have a passage sufficient to receive this latter tube while the fluid-discharge and its holder can be mounted on one side of the shell while means for communicating with the outer end of the wall-traversing tube can be provided on the other side of this wall.

Between the refractory body and the shell, a chamber can be formed to accommodate the U-shaped bend in the flexible tube which permits expansion and contraction without stress transfer. This also allows relative movement of the ceramic body surrounding the pressure-inlet tube and the outer wall of the vessel.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
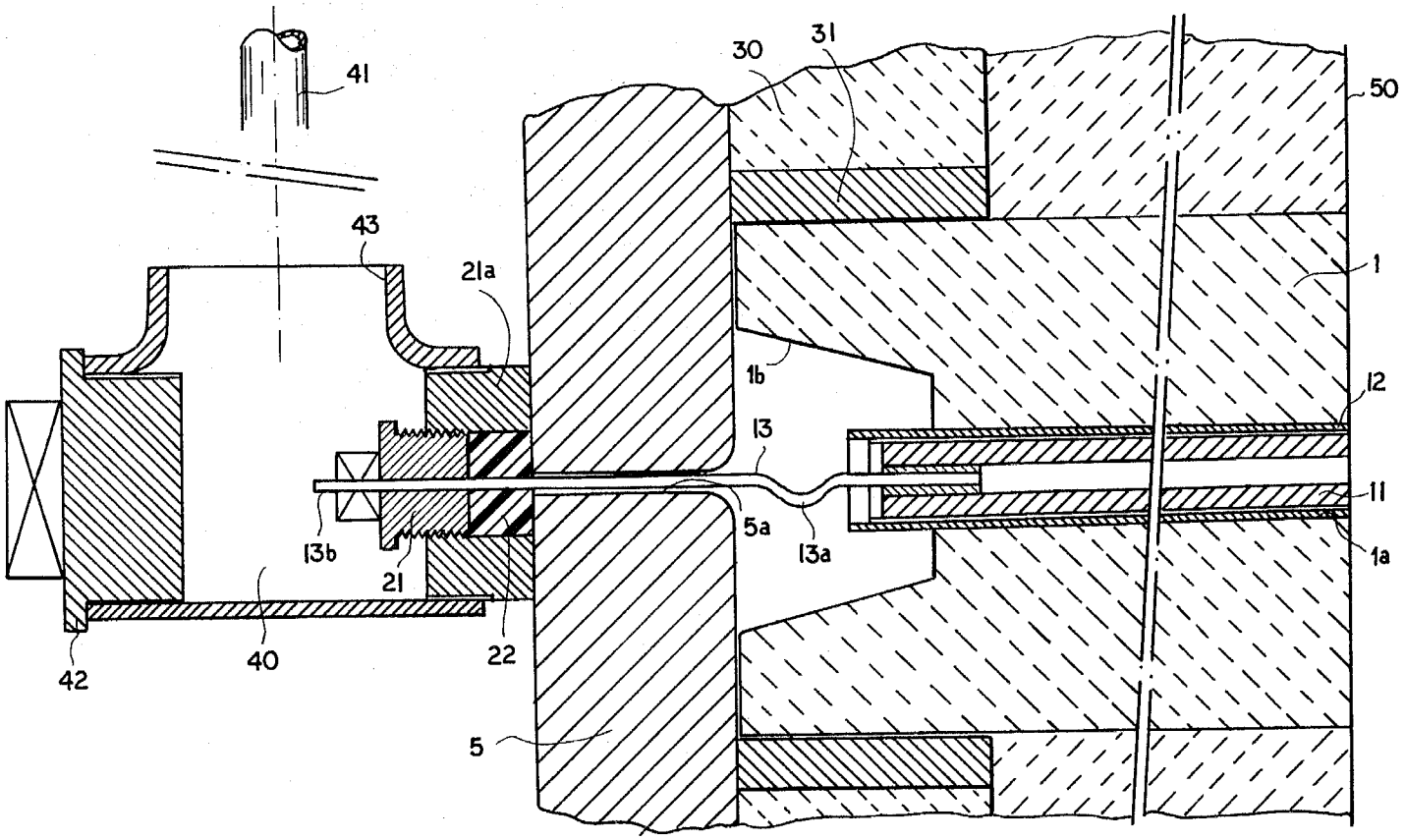
FIG. 1 is a diagrammatic section through a portion of the wall of a crucible or converter provided with a pressure inlet for a system in accordance with the invention.
Figure 2:
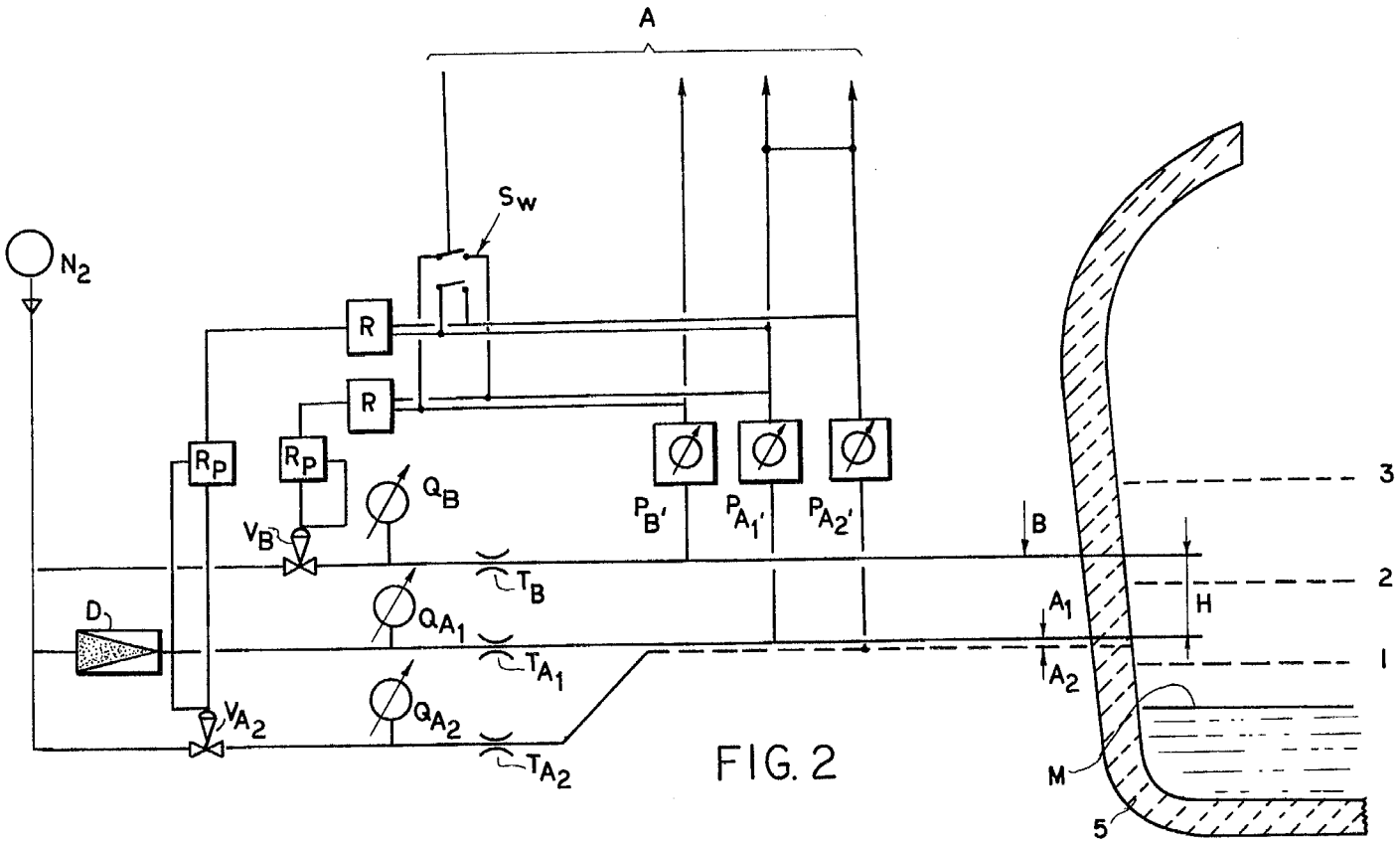
FIG. 2 is a diagram illustrating the principles of the invention.

As can be seen from FIG. 1, a ceramic body or brick 1 is held in place in the packed refractory lining 50 of the crucible, converter or other vessel containing a melt M of molten steel (FIG. 2).

This body 1, of a shape-retentive ceramic has a passage 1*a* whose cross section is maintained even at the elevated temperatures at which the vessel operates. The pressure inlet tube 11, which also can be ceramic, can be received in a metal tube 12 lining the passage 1*a* and affording mechanical protection for the ceramic tube 11 during the blowing of the melt and the filling and discharge of the vessel. The tube 11 forms a pressure inlet which introduces a jet into the melt-containing metallurgical vessel. The combination of these tubes and the refractory brick has been found to be important to ensure reproducibility during the operation of the converter or crucible.

In the cold end of the ceramic pressure inlet tube 11, a flexible tube 13, e.g. of copper, is fitted and held in place by a refractory sealant. The tube 13 has a U-shaped bend 13*a* permitting relative axial movement of the extremity 13*b* and the body 1 and hence movement of the body 1 relative to the wall or casing 5 of the vessel.

The body 1 is formed with a chamber 1*b* accommodating the U-bend 13*a*.

The tube 13 thus traverses a passage 5*a* in the wall or shell 5. Sleeve 31 of refractory fibers surrounds the body 1 and separates it from the permanent lining 30 of the vessel and is compressible to prevent cracking because of relative movement of body 1 and the permanent lining.

Elements 11, 12 and 13 can be replaced together with the body 1 by removing a threaded plug 21 and a seal 22 which is clamped by the plug 21 against wall 5 in an internally threaded sleeve 21*a* welded permanently to the wall 5. Members 21 and 22 thus function as a clamp for the tube 13.

A fitting 40 is threaded onto the sleeve 21*a* and is in turn provided with a plug 42 for connection at 43 to a pipe 41 serving as a source of the inert gas and a connection to a pressure detector or manometer (not shown).

The fitting 40 and pipe 41 have diameters sufficient to prevent pressure drop at the volume of the inert gas injected into the vessel between the manometer and the outlet end or mouth of tube 11.

From FIG. 2 which is diagrammatic and from which the ceramic wall lining has been omitted for clarity, it will be apparent that three such pressure inlets 11 are shown diagrammatically at $A_1$, $A_2$ and B with respective jets and are provided in the wall 5 of the vessel (below the level of trunnions, not shown, thereof). The pressure inlets (jets) $A_1$ and $A_2$ are at the same level above the surface of the melt M and the level of filling prior to commencement of the refining operation or the blowing.

The pressure inlet (jet) B, also having the construction shown in FIG. 1 is disposed at a distance H above the lower-level pressure inlet.

The three pressure inlets (jets) are fed through throttles $T_B$, $T_{A1}$ and $T_{A2}$ from a common nitrogen source represented at $N_2$ at rates determined by the valves $V_{A1}$ and $V_B$ and a pressure reducer D.

The volume rates of flow can be determined by manometers $Q_{A1}$, $Q_{A2}$ and $Q_B$, based upon the calibers of the throttles $T_{A1}$, $T_{A2}$ and $T_B$ and pressure regulators $R_P$ control the valves $V_{A2}$ and $V_B$ to maintain the applied flow rates constant.

The back pressures are measured by the manometers $P_{A1}$, $P_{A2}$, and $P_B$ and regulators R serve to initialize or calibrate the apparatus by bringing the differences $P_{A1}-P_B$ and $P_{A1}-P_{A2}$ to 0. These regulators R are shortcircuited by the switches Sw after initialization has been completed. The manometers $P_{A1}$, $P_{A2}$, and $P_B$ provide their outputs to a calculator and electronic processor A preprogrammed to perform the calculations described above.

After the initialization, the calculator can display values for $\rho$ and h thereby indicating both the density and the level of the slag. The indications begin when the slag rises from its initial level below the lower pressure inlets, e.g. the position 1, to the positions 2 and 3 shown by broken lines in FIG. 2.

The calculator or electronic processor A can be a microprocessor preprogrammed to accurately use the aforementioned calculations and provided with a display or control output for regulating the refining process or the like.

I claim:

1. A method of measuring the level of slag in a top-blown melt-containing metallurgical vessel and a physical parameter of the slag, comprising the steps of:

(a) feeding jets of a gas laterally into said vessel through a lateral wall thereof at two locations spaced above a metallurgical charge in said vessel and disposed one above the other on said wall;

(b) initially establishing flows through said jets to provide equal back pressure therefor;

(c) detecting the back pressures of said jets while maintaining said flows to monitor the hydrostatic head of slag in said vessel at it rises above the lower jet; and (d) determining the position of the slag level and said parameter by monitoring deviations of the detected back pressures from the original back pressures from the fact that the back pressures are proportional to the product of the density of the slag and the height thereof above the lower jet.

2. The method defined in claim 1 wherein said gas is nitrogen.

3. The method defined in claim 1 wherein at least three jets are provided, two of said jets being positioned at the same level along said wall, the third jet being disposed above the level of the two jets.

4. A method of measuring the level of slag in a vessel and a physical parameter of the slag, comprising the steps of:

(a) feeding jets of a gas into said vessel through a wall thereof at two locations spaced above a metallurgical charge in said vessel and disposed one above the other on said wall, at least three jets being provided, two of said jets being positioned at the same level along said wall, the third jet being disposed above the level of the two jets;

(b) initially establishing flows through said jets to provide equal back pressure therefor;

(c) detecting the back pressures of said jets while maintaining said flows to monitor the hydrostatic head of slag in said vessel as it rises above the lower jet; and (d) determining the position of the slag level and said parameter by monitoring deviations of the detected back pressures from the original back pressures using said two jets positioned at the same level, one of said two jets providing a reference indicating the reliability of said determination when the back pressure therein equals the back pressure in the other jet positioned at the same level.

5. A device for determining the level of a layer of slag overlying a metallurgical melt in a top-blown melt-containing metallurgical vessel having a vertical wall and for determining a physical parameter of said slag, said device comprising:

a pair of pressure inlet tubes opening laterally through said wall into said vessel at vertically spaced locations;

means for feeding a gas to said tubes;

means for adjusting the rate of flow of said inert gas to establish substantially identical back pressures at said tubes in the absence of a slag layer in said vessel, said means including valves in said tubes responsive to the back pressures therein;

means connected to said tubes for measuring said back pressures; and means responsive to the measured back pressures and deviations thereof from original back pressure values for indicating the level of slag in said vessel and a physical parameter of said slag upon slag in said vessel rising above the lower pressure inlet, in accordance with the relationship that the back pressures are proportional to the product of the density of the slag and the height thereof above the lower inlet tube.

6. The device defined in claim 5 wherein each of said pressure inlets comprises a ceramic body having a throughgoing passage received in a lining of said wall, a metal tube lining said passage of said refractory body, a further tube received in said metal tube and opening into the interior of said vessel.

7. A device for determining the level of a layer of slag overlying a metallurgical melt in a vessel having a vertical wall and for determining a physical parameter of said slag, said device comprising:

a pair of tubes opening through said wall into said vessel to form pressure inlets at vertically spaced locations, each of said pressure inlets comprising a ceramic body having a throughgoing passage received in a lining of said wall, a metal tube lining said passage of said refractory body, a further tube received in said metal tube and opening into the interior of said vessel, and a flexible tube extending through said wall and connected to said further tube, said body being formed with a chamber turned away from the interior of said vessel and said flexible tube having a U-band received in said chamber means for feeding a gas to said flexible tubes;

means for adjusting the rate of flow of said inert gas to establish substantially identical back pressures at said tubes in the absence of a slag layer in said vessel, said means including valves in said tubes responsive to the back pressures therein;

means connected to said tubes for measuring said back pressures; and means responsive to the measured back pressures and deviations thereof from original back pressure values for indicating the level of slag in said vessel and a physical parameter of said slag upon slag in said vessel rising above the lower pressure inlet, in accordance with the relationship that the back pressures are proportional to the product of the density of the slag and the height thereof above to lower inlet tube.

8. The device defined in claim 7 wherein said wall has a shell, a threaded sleeve being mounted on said shell, said flexible tube passing through said sleeve, each pressure inlet further comprising a seal in said sleeve surrounding said flexible tube and a clamping plug threaded into said sleeve and retaining said tube therein.

9. The device defined in claim 8, further comprising an external fitting mounted on said shell and connected with a pipe communicating with a source of said inert gas and a manometer.

10. The device defined in claim 9 wherein said pressure inlets are disposed below the trunnions of said vessel.

11. The device defined in claim 7 wherein the last-mentioned means includes an electronic processor responsive to electrical signals representing said back pressures and providing an output signal.

* * * * *